US008500420B2

(12) United States Patent
Spiegl et al.

(10) Patent No.: US 8,500,420 B2
(45) Date of Patent: Aug. 6, 2013

(54) SUCTION VALVE WITH UNLOADER

(75) Inventors: Bernhard Spiegl, Vienna (AT); Markus Testori, Hollabrunn (AT); Uwe Fuxa, Vienna (AT)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 982 days.

(21) Appl. No.: 12/000,445

(22) Filed: Dec. 12, 2007

(65) Prior Publication Data

US 2008/0149195 A1 Jun. 26, 2008

(30) Foreign Application Priority Data

Dec. 22, 2006 (AT) ..... A 2128/2006

(51) Int. Cl.
*F04B 7/00* (2006.01)
*F04B 49/00* (2006.01)
*F16K 21/04* (2006.01)

(52) U.S. Cl.
USPC ..... 417/446; 417/298; 137/516.23

(58) Field of Classification Search
USPC ..... 137/528, 522, 516.13, 516.11, 516.23, 137/516.21, 516.17, 540, 523; 417/447, 417/446, 298; 251/214, 321
See application file for complete search history.

(56) References Cited

U.S. PATENT DOCUMENTS

| | | | | | |
|---|---|---|---|---|---|
| 3,294,314 | A | * | 12/1966 | Ott et al. | 417/446 |
| 3,358,710 | A | * | 12/1967 | Page | 137/512.1 |
| 3,360,006 | A | * | 12/1967 | Kehler | 137/516.13 |
| 3,463,184 | A | * | 8/1969 | Kohler et al. | 137/512.15 |
| 3,703,912 | A | * | 11/1972 | Bauer et al. | 137/514 |
| 4,483,363 | A | * | 11/1984 | Madoche et al. | 137/329.04 |
| 4,632,145 | A | * | 12/1986 | Machu | 137/516.21 |
| 4,723,572 | A | * | 2/1988 | Tuymer | 137/514 |
| 4,799,507 | A | * | 1/1989 | Hrabal | 137/516.21 |
| 4,852,608 | A | * | 8/1989 | Bennitt | 137/516.13 |
| 4,854,341 | A | * | 8/1989 | Bauer | 137/514 |
| 4,869,289 | A | * | 9/1989 | Hrabal | 137/512.1 |
| 4,869,291 | A | * | 9/1989 | Hrabal | 137/516.21 |
| 4,913,187 | A | * | 4/1990 | Woollatt et al. | 137/516.13 |
| 4,924,906 | A | * | 5/1990 | Hrabal | 137/512.1 |
| 5,025,830 | A | * | 6/1991 | Kursar | 137/522 |
| 5,036,880 | A | * | 8/1991 | Safford et al. | 137/516.21 |
| 5,052,434 | A | * | 10/1991 | Bauer | 137/516.13 |
| 5,378,117 | A | * | 1/1995 | Bennitt | 417/298 |
| 5,390,698 | A | * | 2/1995 | Frazzini | 137/496 |
| 5,634,492 | A | * | 6/1997 | Steinruck et al. | 137/522 |
| 5,642,753 | A | * | 7/1997 | Thistle et al. | 137/512.1 |
| 5,678,603 | A | * | 10/1997 | Tschop | 137/512.1 |
| 5,785,081 | A | * | 7/1998 | Krawczyk et al. | 137/516.23 |
| 6,149,400 | A | * | 11/2000 | Samland et al. | 417/298 |
| 6,510,868 | B2 | * | 1/2003 | Penza | 137/516.23 |
| 6,971,861 | B2 | * | 12/2005 | Black et al. | 417/440 |
| 2002/0002997 | A1 | * | 1/2002 | Steinruck et al. | 137/516.11 |
| 2004/0091365 | A1 | * | 5/2004 | Spiegl et al. | 417/53 |

FOREIGN PATENT DOCUMENTS

DE 4431512 3/1996

OTHER PUBLICATIONS

English Abstract of DE 4431512.

* cited by examiner

*Primary Examiner* — Charles Freay
*Assistant Examiner* — Alexander Comley
(74) *Attorney, Agent, or Firm* — Dykema Gossett PLLC

(57) ABSTRACT

A suction valve includes a non-rotatable lock sleeve 20 concentrically arranged on a valve seat 3, the lock sleeve having a non-circular outer contour onto which an unloader 22 is placed with its radial central section 28 and which is correspondingly formed in a diametrically opposed manner to prevent turning.

16 Claims, 3 Drawing Sheets

SUCTION VALVE WITH UNLOADER

BACKGROUND OF THE INVENTION

1. Field of the Invention

The present invention relates to a suction valve including a valve seat (3), a valve guard (2) and a valve element (4) which is arranged in a reciprocating manner between valve seat (3) and valve guard (2), and further including an unloader (22) having a plurality of fingers (24) which reach through flow passages (13) in the valve seat (3) and which lie against the valve element (4), whereby the unloader (22) is arranged in a non-rotational manner relative to the valve seat (3) and is guided in an axial direction by means of an anti-rotation lock for the unloader.

2. The Prior Art

Suction valves of compressors are often designed with unloaders. Such unloaders essentially serve to start the compressor under no load or to switch the compressor to an idling operation.

To prevent wear of the unloader against the guide element, especially during dry-running of compressors, guide strips and guide rings in the unloader guides have been used for years, as exemplarily shown in EP 686 770 or DE 44 31 512 A1. In addition, rotation of the unloader is limited by the use of stopping blocks 21 made of a synthetic material, as illustrated in FIG. 3. Such stopping blocks 21 are screwed to the valve seat 3 by means of screws 23. Should this prevention against rotation be eliminated, the unloader fingers 14 would rub against the bridges of the passage openings 13 on the valve seat 3 and cause damage to the valve and/or to the unloaders themselves due to the high degree of wear. Based on the many geometric shapes of valve designs, the stopping blocks 21 would have to be additionally made to fit for each valve and be produced and stored in small numbers. Costs caused by this process become correspondingly high. Besides, the stopping blocks 21 can negatively influence the flow conditions in the valve.

It is therefore the object of the present invention to provide an anti-rotation lock and a guide for an unloader of a suction valve which can be generally employed in suction valves of different geometric shapes without negative influences on the functioning of the suction valve.

SUMMARY OF THE INVENTION

This object is achieved in that the unloader lock is designed as a cylinder-shaped lock sleeve, which is arranged in a non-rotatable manner and is concentric relative to the valve seat and whereby the cylinder-shaped lock sleeve is provided with a base area having a non-circular outer contour, and whereby there is arranged on the unloader a central section having an axially through-going concentric opening with an inner contour that is diametrically opposed to said outer contour, and whereby the unloader is arranged with its central section on the lock sleeve for the purpose of guidance and anti-rotation of the unloader. Such a lock sleeve arranged centrally and radially inside can be employed in valves of the most different geometries since the lock element is independent from the geometry of the suction valve. Besides, the flow conditions of the suction valve cannot be influenced in the area of the flow passages because of the special arrangement of the lock sleeve. Yet, simple and secure anti-rotational locking and guiding of the unloader can be realized.

The lock sleeve can be simply arranged in the valve seat in an anti-rotatable manner if a concentric recess is provided in the valve seat having an outer contour that is diametrically opposed to the inner contour. A projection can be provided extending axially from the face of the lock sleeve and facing the valve seat, whereby said projection is arranged in a recess in the valve seat.

A simple limitation of the movement of the unloader can be achieved in that an annular section is provided extending in axial direction in the area of the lock sleeve facing the valve seat. A stop in axial direction is created for said unloader with this arrangement. The axial movement limitation of the unloader can be simply adjusted through the height of the annular section.

The outer contour of the lock sleeve or the inner contour of the unloader can be selected in any desired way. It is especially advantageous to make the contour undulated or in the shape of a polygonal course or a polygon since such contours can be manufactured easily and precisely.

If the lock sleeve is designed in shape of a hollow cylinder and a cylinder-shaped sleeve is arranged inside the lock sleeve, the materials for the lock sleeve and for the other sleeve can be selected according to their related functions. For example, the lock sleeve can be made of a material that ensures the least possible friction between the lock sleeve and the unloader, and the inner sleeve can be made of a material of high strength to securely transfer the initial tensional force of the bolt onto the valve seat.

The present invention is described in the following with the aid of schematic, non-limiting drawings in FIG. 1 through FIG. 8, which respectively illustrate a preferred embodiments of the invention.

DETAILED DESCRIPTION OF THE PREFERRED EMBODIMENTS

Figure 1:
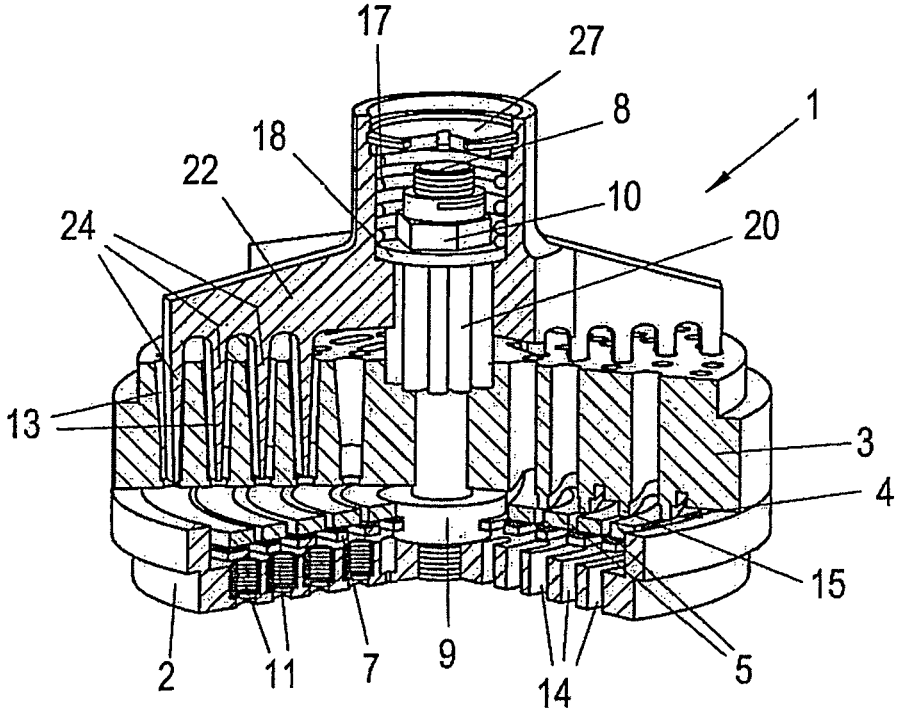
FIG. 1 shows a section through the suction valve with a unloader according to the invention.
Figure 3:
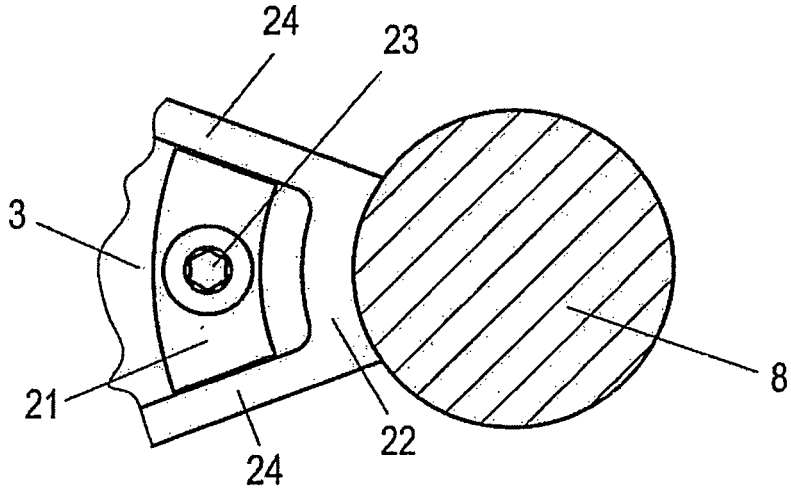
FIG. 3 shows an anti-rotation lock for the unloader according to prior art.
Figure 2:
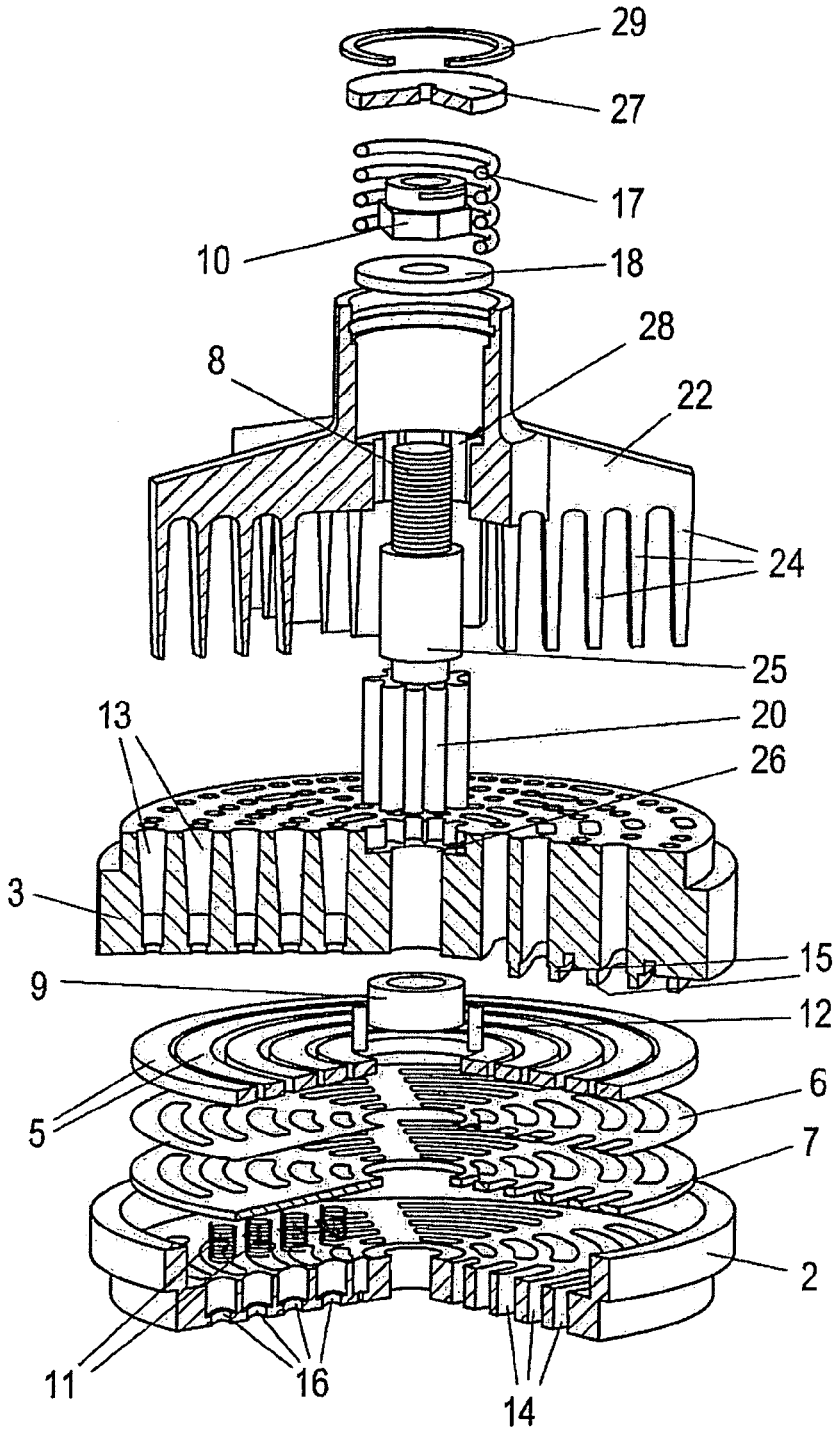
FIG. 2 shows an exploded view of this suction valve.

The basic design of a suction valve 1 is known in the art heretofore and for that reason it is only briefly discussed here with reference to FIG. 1 and FIG. 2. A suction valve 1 for employment in compressors, for example, consists of a valve seat 3 and a valve guard 2. A valve element 4 is arranged between the same, which is moved back and forth between the valve seat 3 and the valve guard 2, and which takes on the sealing function in cooperation with the valve seat 3 whereby it closes and opens the annular flow passages 13 in the valve seat 1. The individual parts of the suction valve 1 are held together by means of a through-going bolt 8 and a nut 10 disposed at the opposite end, whereby the bolt is screwed into the valve guard 2. The space between the valve seat 3 and the valve guard 2, and thereby the possible valve unloader, is adjusted through a spacer disk 9 that is arranged on the bolt 8. Annular outlet passages 14 are additionally arranged in the valve guard 2.

A unloader 22 is arranged at the end of the bolt 8 facing away from the valve element 4, whereby the fingers 24 of the unloader 22 reach through the flow passages 13 on the valve seat 3 and lie against the valve element 4. The unloader 22 is held on a sleeve 25 by the nut 10 and through a disk 18, whereby the sleeve 25 transfers the initial tensional force of the bolt to the valve seat 3. A spring 17 lies closely against the disk 18, whereby the opposite end of the spring 17 lies against a second disk 27 disposed further away from the valve seat 3. The second disk 27 is held here in the unloader 22 by means of a retaining ring 29. Based on this arrangement, the unloader 22 can be moved in axial direction against the resilient force of the spring 17 in the direction of the valve guard 2 whereby the valve element 4 is lifted from the valve seat 3 and the flow passages 13 are opened thereby. The return position of the unloader 22 occurs automatically through the resilient force of the spring 17. Of course, the axial movement of the unloader can also be realized through any other suitable arrangement.

A unloader 22 is arranged at the end of the bolt 8 facing away from the valve element 4, whereby the fingers 24 of the unloader 22 reach through the flow passages 13 on the valve seat 3 and lie against the valve element 4. The unloader 22 is held on a sleeve 25 by the nut 10 and through a disk 18, whereby the sleeve 25 transfers the initial tensional force of the bolt to the valve seat 3. A spring 17 lies closely against the disk 18, whereby the opposite end of the spring 17 lies against a second disk 27 disposed further away from the valve seat 3. The second disk 27 is held here in the unloader 22 by means of a retaining ring 29. Based on this arrangement, the unloader 22 can be moved in an axial direction against the resilient force of the spring 17 in the direction of the valve guard 2 whereby the valve element 4 is lifted from the valve seat 3 and the flow passages 13 are opened thereby. The return position of the unloader 22 occurs automatically through the resilient force of the spring 17. Of course, the axial movement of the unloader can also be realized through any other suitable arrangement.

The valve element 4 comprises concentrically arranged sealing rings 5 which cooperate with the valve seat 3. Moreover, associated and cooperating sealing surfaces are respectively arranged on the sealing rings 5 and on the valve seat 3. The sealing surfaces on the sealing rings 5 can be flat, for example (which means they can lie at a normal plane to the axis of the annual valve 1); however, the sealing rings 7 could also be provided with tapered edges serving as sealing surfaces, for example—or the sealing rings 5 could also have toroidal sealing surfaces. Any sealing surfaces formed otherwise are still possible in principle. In any case, all correspondingly arranged sealing surfaces on the valve seat 3 are shaped to match each other.

A plurality of guide studs 15 projecting axially from the valve seat 3 in the direction of the sealing rings 5 are arranged on the valve seat 3 whereby the guide studs are distributed along the circumference of the valve seat at varying radial distances to one another, and whereby the individual sealing rings 5 are arranged between the ring guide studs in radial and in axial direction. The ring guide studs 15 project thereby from the valve seat 3 at least to such a degree that the sealing rings 5 remain in place during the entire opening movement of the ring.

Moreover, the valve element 4 may comprise a synchronizing plate 7, which is arranged on the sides of the sealing rings 5 facing away from the valve seat 3 and which covers the sealing rings 5. The synchronizing plate 7 is biased by a row of helical springs 11 arranged in spring pockets 16 in the valve guard 2. The helical springs 11 press thereby the sealing rings 5 against the valve seat 3 with the synchronizing plate 7. The sealing rings 5 are lifted away from the valve seat 3 through the existing gas pressure acting against the force of the helical springs 11 during the opening movement of the rings. Flat springs could also be provided, as known in the art, in place of the helical springs 11—or spring action could be achieved through resilient arms bent away from the synchronizing plate 7.

A metallic separating plate 6 is arranged between the synchronizing plate 7 and the sealing rings 5, which prevents the synchronizing plate 7 and the sealing rings 5 from directly contacting and wearing each other down. The separating plate 6 is a thin flat metallic disk, for example, but it could also be shaped in any other way, e.g., curved (depending on the shape of the synchronizing plate 7 and/or the sealing rings). Of course, a number of preferably annular flow passages are arranged again in the synchronizing plate 7 and the separating plate 6 (actually a number of semi-circular sections which are separated by radial bridges), so that the gaseous medium can pass through the annular valve 1 with the least restriction possible.

The synchronizing plate 7, the separating plate, and the sealing rings 5 form in this example the valve elements 4 of the suction valve 1, they lie loosely against one another and are mutually moved during the ring opening movement. These parts can no longer wear each other down by the continuous movement of the valve element 4 because of the separation of the synchronizing plate 7 and the sealing rings 5 by means of the separating plate 6. Of course, the valve element can also be designed differently, e.g., without a separating plate 6 or without a synchronizing plate 7—or with a sealing plate in place of the sealing rings 5, this is, however, unimportant for the present invention.

The flow openings of the synchronizing plate 7 and of the separating plate 6 leading to the flow passages 13 of the valve seat 3 or to the outlet passages 14 of the valve guard 2 remain properly positioned (and the available flow cross section is not reduced), and it is prevented thereby that these parts turn against one another, which can be achieved by means of a locking pin 12 inserted through these parts and also running through the valve guard 2 and the valve seat 3. This rotational locking of the valve can naturally be also achieved through any other possible means, e.g., through corresponding projections and stops on the individual parts.

An anti-rotational locking device is provided for the unloader to prevent turning of the unloader 22 relative to the valve seat 3, since the unloader fingers 24 can make contact and rub against the radial cross pieces between the flow passages 13, which can lead to increased wear and/or to damage to the unloader fingers 24 and/or to the valve seat 3. The anti-rotational locking device for the unloaders consists of a cylindrical lock sleeve 20, which is fixedly held in place in the valve seat 3. The lock sleeve 20 is thereby arranged concentric around the bolt 8 and between the valve seat 3 and the nut 10. The lock sleeve 20 can also be used to transfer the initial tensional force of the bolt, whereby the sleeve 25 could be completely eliminated, or the lock sleeve 20 could be could be placed over the sleeve 25, or arranged around the same in some other way. The lock sleeve 20 can be made thereby of metal, as for example bronze, brass or any similar material, or it could be made of a synthetic material or fiber reinforced synthetic material such as polyether ether ketone (PEEK), polyphenylene sulfide (PPS), polytetrafluoroethylene (PTFE), polyoxymethylene (POM) or polyamide (PA). Basically, the material for the lock sleeve 20 in relationship to the material of the unloader 22 should of course be selected in such a manner that the developing friction between the unloader 22 and the lock sleeve 20 will be as low as possible to minimize wear through the guiding elements. The sleeve 25 is made preferably of metal or of a material of similar strength to be able to transfer the initial tensional force.

Figure 6:
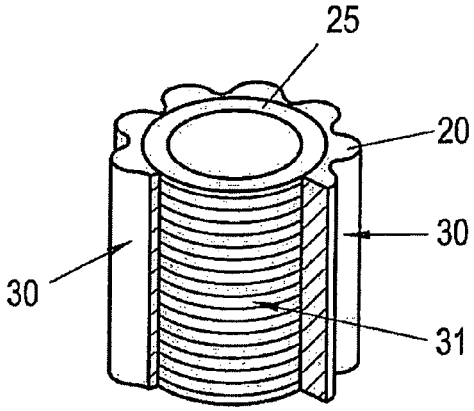
FIG. 6 shows a detailed view of a cylinder-shaped lock sleeve.

The sleeve 25 and the lock sleeve 20 could naturally be made as a combined part, as illustrated in FIG. 6. The cylindrical sleeve 25 made of metal, for example, has thereby a ribbed or grooved outer contour 31, whereby the sleeve 25 is molded in an injection molding process together with the forming of the lock sleeve 20 and the stopping faces 30, e.g., with a suitable synthetic material. The sleeve 25 and the lock sleeve 20 are thus connected to one another in a positive fit to form a combined component.

The lock sleeve 20 is provided with a surface area having an outer contour that is not completely round so that a cylindrical sleeve is created which has a circumferential surface with axially oriented stopping faces 30, which prevent turning in conjunction with the corresponding counter profile. The unloader 22 is placed at a radial central section 28 with a fitting inner contour against the corresponding counter profile. The unloader 22 is pushed with its central section 28 onto the lock sleeve 20 so that the outer contour of the lock sleeve 20 cooperates with the inner contour of the section 28. Any turning of the unloader 22 is prevented thereby relative to the lock sleeve 20 and thereby also relative to the valve seat 3.

Figure 4:
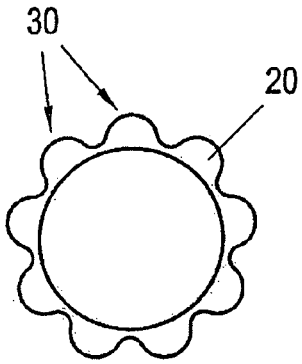
FIG. 4 and FIG. 5 show an example of a possible surface area of the cylinder-shaped lock sleeve each.
Figure 5:
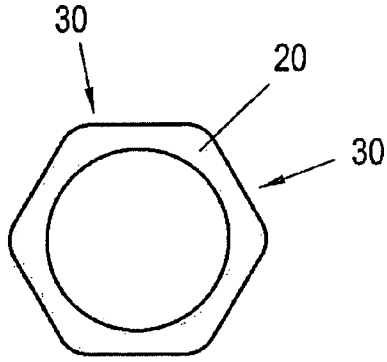

The outer contour of the surface of the lock sleeve 20 can be formed thereby in almost any desired way, a very simple shape would be an elliptical shape. Examples of possible outer contours are illustrated in FIG. 4 and FIG. 5. According to FIG. 4, the outer contour is made of a row of circular segments curved in opposite directions to one another so that an undulated outer contour is created. The flanks of the curved parts are thereby the stopping faces 30 of the circumferential surface. However, the outer contour could also be in the shape of a polygonal course or a polygon. The outer contour in FIG. 5 is shaped in the form of a hexagon, in this case with rounded corners (it could also be any other polygon) whereby the stopping faces 30 are made of the side surface of the hexagon (or the polygon). The inner contour of the counter profile in the unloader 22 would then be shaped diametrically opposed, as in this case a undulated contour or an inner hexagon—it comprises again corresponding stopping faces. The unloader 22 can no longer turn relative to the lock sleeve 20 because of the matching stopping faces 30 on the outer contour of the lock sleeve 20 and on the inner contour of the unloader 22. At least two respective cooperating stopping faces 30 are necessary on the inner and outer contour to prevent turning of the lock sleeve 20.

However, the lock sleeve 20 has also a guiding function whereby the unloader 22 is guided in axial direction through the non-circular area of the lock sleeve 20. The outer contours and the associated inner contour could be equipped with a suitable play, which allows the most possible unrestricted and friction-free axial movement. Nevertheless, the play should not be too great to avoid that the lock sleeve 20 may still turn back and forth in a small space, which can increase wear. It is advantageous in this connection to have contours with steep flanks, as shown in FIG. 4, since the unloader can then be aligned precisely, exact guidance is ensured and any play of the unloader 22 in circumferential direction can be kept very small (and thereby any back and forth turning is kept to a minimum). Likewise, friction between the lock sleeve 20 and the unloader 22 can be reduced through a suitable selection of materials.

Of course, one prerequisite for the functioning of the non-rotational lock is the fact that the lock sleeve itself is arranged in a way to prevent turning relative to the valve seat 3. This can be achieved in the simplest way through a frictional connection whereby the lock sleeve 20 is pressed against the valve seat 3 by the initial tensional force of the bolt so that these parts can no longer turn—or hardly turn—through the developing friction forces. However, a connection with positive fit is more secure as shown in the presently described embodiment example according to FIG. 1 and FIG. 2. A recess 26 is thereby arranged in the valve seat 3, which represents a counter profile to the outer contour of the lock sleeve 20 (as described above). There need not exist any play in this connection and a press fit could be provided so that the lock sleeve 20 cannot not turn at all relative to the valve seat 3 and whereby said lock sleeve 20 can be securely held in place in the valve seat 3. The recess 26 can be produced by a traditional method, e.g., cutting, blasting, boring etc. This contour can be very simply created through boring if the contour consists of circular sections.

Figure 7:
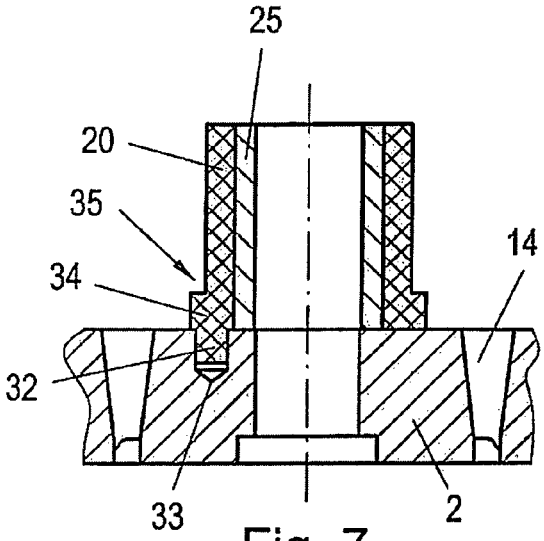
FIG. 7 and FIG. 8 show an additional embodiment of a lock sleeve according to the invention.
Figure 8:
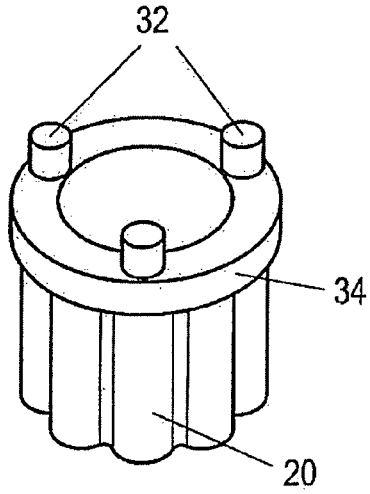

Another possibility to arrange the lock sleeve 20 in a non-rotatable manner is described with the aid of FIG. 7 and FIG. 8. Projections 32 are hereby arranged on the face of the lock sleeve 20 associated with the valve seat 3, in this case they are cylindrical tappets which are inserted into the respective recesses 33 (here borings) on the valve seat 3, whereby the lock sleeve 20 can no longer turn relative to the valve seat 3.

In addition it can be proposed that an annular section 34, extending in axial direction, is molded to an area of the lock sleeve 20 that is part of the valve seat 3, whereby said annular section has here a larger radius (not out of necessity) than the radius of the enveloping casing area of the lock sleeve 20, as shown in FIG. 7 and FIG. 8. A shoulder 35 is thereby created at the transition to the annular section 34, whereby said shoulder can be used as axial stop for the unloader 22. The axial movement of the unloader 22 can be limited thereby. A corresponding stop element for the unloader 22 can also be made without the shoulder 35, e.g. in that the annular section has as its outer radius the radius of the enveloping casing area of the lock sleeve 20.

The invention claimed is:

1. A suction valve which comprises:

a valve seat having flow passages therethrough, a valve guard having outlet passages therethrough, a valve element movably positioned between said valve seat and said valve guard and capable of opening or closing the flow passages in the valve seat, spring means between the valve guard and the valve element to bias said valve element towards said valve seat, a one-piece unloader located on a side of said valve seat opposite said valve element, said unloader consisting of a plurality of fingers which extend through some of said flow passages of said valve seat to contact said valve element, and a central section having an out-of-round inner wall defining an axial opening therein, an inner sleeve which extends from said valve seat through said axial opening of said unloader, a separate, generally cylindrical lock sleeve which surrounds said inner sleeve and which is non-rotatably connected to said valve seat and extends into said central opening of said unloader, said lock sleeve having an out-of-round outer contour which interlocks with the out-of-round inner wall of the central section of the unloader to prevent relative rotation therebetween and prevent said fingers of said unloader from contacting walls of said valve seat forming said flow passages through which said fingers extend, a central connecting bolt which extends from a first end attached to said valve guard though said valve element, said valve seat, said inner sleeve, and said unloader to an exposed second end, and a nut attached to said second end of said bolt to hold said unloader on said inner sleeve.

2. The suction valve according to claim 1, wherein said valve seat includes a recess and wherein said lock sleeve includes an axial projection which extends into said recess to non-rotatably connect said lock sleeve to said valve seat.

3. The suction valve according to claim 1, including an annular section extending in an axial direction in the area of the lock sleeve facing the valve seat.

4. The suction valve according to claim 1, wherein the out-of-round outer contour of the lock sleeve or the out-of-round inner wall of the central section of the unloader is in the form of a polygonal course.

5. The suction valve according to claim 1, wherein the out-of-round outer contour of the lock sleeve or the out-of-round inner wall of the central section of the unloader is in the form of a polygon.

6. The suction valve according to claim 1, wherein the lock sleeve is made of a material selected from the group consisting of metal, synthetic material, and a filled or fiber reinforced synthetic material.

7. The suction valve according to claim 1, wherein said inner sleeve comprises a hollow cylinder.

8. The suction valve according to claim 7, wherein the lock sleeve is molded around the inner sleeve to form a combined component.

9. The suction valve according to claim 1, wherein the outer contour of said lock sleeve is defined by axially oriented undulations, and the inner wall of said central section of said unloader comprises corresponding axially oriented undulations.

10. The suction valve according to claim 1, wherein said valve seat includes an inner wall which defines a concentric recess, said inner wall having an out-of-round contour which corresponds to the out-of-round contour of said lock sleeve to enable non-rotatable connection of said lock sleeve to said valve seat when said lock sleeve is positioned in said recess.

11. The suction valve according to claim 1, wherein the out-of-round outer contour of said lock sleeve and the out-of-round inner wall of the central section of the unloader have a corresponding undulating shape.

12. The suction valve according to claim 1, wherein the inner sleeve is made of metal.

13. The suction valve according to claim 1, wherein said spring means comprise a plurality of helical springs extending from the valve guard toward the valve element.

14. The suction valve according to claim 13, including a synchronizing plate between said valve guard and said valve element, and said plurality of helical springs extend from the valve guard toward the synchronizing plate.

15. The suction valve according to claim 8, wherein said inner sleeve consists of metal and said lock sleeve consists of a synthetic material.

16. The suction valve according to claim 15, wherein said synthetic material is a polymer selected from the group consisting of polyether ether ketone, polyphenylene sulfide), polytetrafluoroethylene, polyoxymethylene and polyamide.

* * * * *